US010186371B2

(12) United States Patent
Olyunin et al.

(10) Patent No.: US 10,186,371 B2
(45) Date of Patent: Jan. 22, 2019

(54) MAGNETIC FIELD GENERATION APPARATUS HAVING PLANAR STRUCTURE

(71) Applicant: Samsung Electronics Co., Ltd., Suwon-si (KR)

(72) Inventors: Nikolay Nikolaevich Olyunin, Perm (RU); Ki Young Kim, Yongin-si (KR); Keum Su Song, Seoul (KR); Mikhail Nikolaevich Makurin, Arkhangelsk (RU)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1077 days.

(21) Appl. No.: 14/306,957

(22) Filed: Jun. 17, 2014

(65) Prior Publication Data

US 2015/0009000 A1 Jan. 8, 2015

(30) Foreign Application Priority Data

Jul. 8, 2013 (RU) ..... 2013130968
Dec. 13, 2013 (KR) ..... 10-2013-0155497

(51) Int. Cl.
*H01F 17/00* (2006.01)
*H01F 5/00* (2006.01)
*H01F 38/14* (2006.01)

(52) U.S. Cl.
CPC ..... *H01F 38/14* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS 5,952,893 A * 9/1999 Ghoshal ..... H01F 17/0006 257/531
2003/0085676 A1* 5/2003 Binnard ..... H02K 41/03 318/114
2003/0117251 A1* 6/2003 Haugs ..... G05F 1/32 336/182
2005/0195063 A1* 9/2005 Mattsson ..... H01F 27/346 336/225
2010/0141042 A1 6/2010 Kesler et al.
2010/0220025 A1* 9/2010 Savry ..... G06K 19/07749 343/788

(Continued)

FOREIGN PATENT DOCUMENTS

RU 2 481 689 C1 5/2013
RU 2 481 704 C1 5/2013
RU 2 481 705 C1 5/2013

OTHER PUBLICATIONS

M. Catrysse et al., "An inductive power system with integrated bi-directional data-transmission," *Sensors and Actuators A: Physical, The 17th European Conference on Solid-State Transducers*, vol. 115, Nos. 2-3, Sep. 21, 2004, pp. 221-229.

(Continued)

*Primary Examiner* — Tsz Chan
(74) *Attorney, Agent, or Firm* — Nixon & Vanderhye P.C.

(57) ABSTRACT

A magnetic field generation apparatus includes a plurality of coplanar inductors disposed to form a planar structure, wherein each of the coplanar inductors is configured to generate a magnetic field having a basis vector that is orthogonal to a basis vector of a magnetic field generated by another one of the coplanar inductors.

18 Claims, 7 Drawing Sheets

(56) References Cited

U.S. PATENT DOCUMENTS

| | | | | |
|---|---|---|---|---|
| 2011/0046438 | A1 | 2/2011 | Iwaisako | |
| 2011/0163824 | A1* | 7/2011 | Kawano | H01F 21/02 333/17.3 |
| 2012/0001715 | A1* | 1/2012 | Taracila | G01R 33/365 336/200 |
| 2012/0161530 | A1* | 6/2012 | Urano | H02J 7/025 307/104 |
| 2012/0244802 | A1* | 9/2012 | Feng | H04B 5/0087 455/41.1 |
| 2014/0070622 | A1* | 3/2014 | Keeling | H02J 50/12 307/104 |
| 2014/0077919 | A1* | 3/2014 | Godoy | H01F 27/006 336/220 |
| 2014/0218120 | A1* | 8/2014 | Hekmat | H03B 5/1228 331/45 |
| 2014/0340940 | A1* | 11/2014 | Ouyang | H01F 30/06 363/17 |
| 2015/0054348 | A1* | 2/2015 | Akiya | H02J 7/025 307/104 |

OTHER PUBLICATIONS

R. Harrison, "Designing Efficient Inductive Power links for Implantable Devices," *Proceedings of the 2007 IEEE International Symposium on Circuits and Systems*, (*ISCAS 2007*), pp. 2080-2083, conference held May 27-30, 2007, New Orleans, paper presented on May 29, 2007.

U.-M. Jow et al. "Design and Optimization of Printed Spiral Coils for Efficient Transcutaneous Inductive Power Transmission," *IEEE Transactions on Biomedical Circuits and Systems*, vol. 1, No. 3, Sep. 25, 2007, pp. 193-202.

R. Carta, et al., "Wireless powering for a self-propelled and steerable endoscopic capsule for stomach inspection," *Biosensors and Bioelectronics*, vol. 25, No. 4, Dec. 15, 2009, pp. 845-851, paper available online on Sep. 4, 2009.

A. RamRakhyani et al., "Design and Optimization of Resonance-Based Efficient Wireless Power Delivery Systems for Biomedical Implants," *IEEE Transactions on Biomedical Circuits and Systems*, vol. 5, No. 1, Feb. 2011, pp. 48-63.

* cited by examiner

MAGNETIC FIELD GENERATION APPARATUS HAVING PLANAR STRUCTURE

CROSS-REFERENCE TO RELATED APPLICATIONS

This application claims the benefit under 35 USC 119(a) of Russian Patent Application No. 2013130968 filed on Jul. 8, 2013, in the Russian Federal Service for Intellectual Property, and Korean Patent Application No. 10-2013-0155497 filed on Dec. 13, 2013, in the Korean Intellectual Property Office, the entire disclosures of which are incorporated herein by reference for all purposes.

BACKGROUND

1. Field

This disclosure relates to an apparatus having a planar structure to generate a magnetic field for wireless power transmission and reception.

2. Description of Related Art

Wireless energy transmission technology may be used to charge mobile devices, for example, a telephone, a camera, a video camera, an audio player, an electronic shaver, a lantern, and any other mobile device known to one of ordinary skill in the art.

In addition, wireless energy transmission technology may be used in a biomedical field to transmit power to a device implanted into a body. As an example, when the wireless energy transmission technology is applied to the biomedical field, a transmission axis of a receiving end may be arbitrarily changed relative to a transmitting end. For example, when power is wirelessly transmitted to a capsule endoscope, and when a transmitting end and a receiving end include a plane inductor, a transmission axis of the receiving end may be arbitrarily changed, and thus the transmitting end and the receiving end may experience difficulties in communication and transmission and reception of energy.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a magnetic field generation apparatus includes a plurality of coplanar inductors disposed to form a planar structure; wherein each of the coplanar inductors is configured to generate a magnetic field having a basis vector that is orthogonal to a basis vector of a magnetic field generated by another one of the coplanar inductors.

The apparatus may further include a current controller configured to control an amount of current flowing through each of the coplanar inductors; wherein a direction of a magnetic field formed by a linear combination of the magnetic fields generated by the coplanar inductors is determined by the amount of current flowing through each of the coplanar inductors.

The current controller may be further configured to control a phase difference of the current flowing through each of the coplanar inductors so that the magnetic field formed by the linear combination of the magnetic fields generated by the coplanar inductors has a non-linear polarization.

The coplanar inductors may be disposed in a geometry so that vectors of the magnetic fields generated by the coplanar inductors are orthogonal with respect to one another in a preset region and form a three-dimensional basis.

The preset region may be adjacent to the planar structure at a distance less than or equal to a maximum geometrical dimension of the magnetic field generation apparatus.

The coplanar inductors may be disposed in a geometry so that a mutual inductance of each pair of the coplanar inductors is 0.

One of the coplanar inductors may have a shape of an outer frame of the magnetic field generation apparatus; and two of the coplanar inductors may have a shape of a FIG. 8.

Each of the coplanar inductors may have a shape of a sector of a ring.

In another general aspect, a magnetic field generation apparatus includes three coplanar inductors disposed in a planar structure; and a current controller configured to control an amount of current flowing through each of the coplanar inductors; wherein the coplanar inductors are disposed in a geometry so that vectors of magnetic fields generated by the coplanar inductors form a full three-dimensional basis in a preset region of a space located adjacent to the planar structure at a distance less than or equal to a maximum geometrical dimension of the magnetic field generation apparatus.

The three coplanar inductors may be disposed in the geometry so that each pair of the three coplanar inductors has a mutual inductance of 0.

The vectors of the magnetic fields generated by the three coplanar inductors may be orthogonal to one another in the preset region of the space.

The current controller may be further configured to control a phase difference of the current flowing through each of the three coplanar inductors.

In another general aspect, a magnetic generation apparatus includes a plurality of coplanar inductors disposed in a planar structure; and a current controller configured to control an amount of current flowing through each of the coplanar inductors; wherein each of the coplanar inductors has a shape and an orientation in the planar structure that enables the current controller to control the amount of current flowing through each one of the coplanar inductors without affecting the amount of current flowing through every other one of the coplanar inductors.

The shape and the orientation of each of the coplanar inductors may be determined so that each of the coplanar inductors has a mutual impedance of 0 with respect to every other one of the coplanar inductors.

The coplanar inductors may be stacked one on top of another in the planar structure.

The coplanar inductors may include a first coplanar inductor having a first shape; a second coplanar inductor having a second shape; and a third coplanar inductor having the second shape and rotated by 90° with respect to the second coplanar inductor.

The coplanar inductors may include a first coplanar inductor configured to generate a first magnetic field having a first basis vector perpendicular to a plane of the planar structure; a second coplanar inductor configured to generate a second magnetic field having a second basis vector parallel to the plane of the planar structure; and a third coplanar inductor configured to generate a third magnetic field having a third basis vector parallel to the plane of the planar structure and perpendicular to the second basis vector.

The coplanar inductors may be disposed in a same plane except for an overlapping area of each of the coplanar inductors that overlaps a portion of another one of the coplanar inductors.

The overlapping area of each of the coplanar inductors may be determined so that each of the coplanar inductors has a mutual impedance of 0 with respect to every other one of the coplanar inductors.

Each of the coplanar inductors may have a same shape as every other one of the coplanar inductors, and may be rotated by a predetermined angle within the planar structure with respect to a geometrical center of the planar structure relative to another one of the coplanar inductors so that each of the coplanar inductors is oriented at a different rotational position within the planar structure relative to every other one of the coplanar inductors.

Other features and aspects will be apparent from the following detailed description, the drawings, and the claims.

DETAILED DESCRIPTION

Figure 1:
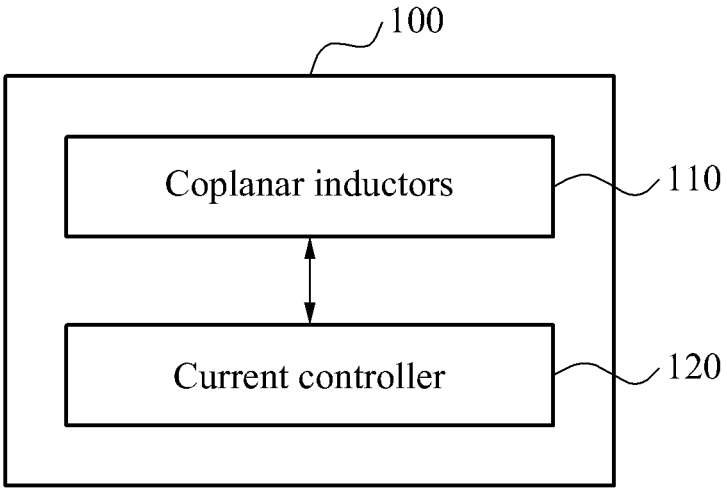
FIG. 1 illustrates an example of a configuration of a magnetic field generation apparatus.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

Throughout the drawings and the detailed description, the same reference numerals refer to the same elements. The drawings may not be to scale, and the relative size, proportions, and depiction of elements in the drawings may be exaggerated for clarity, illustration, and convenience.

A magnetic field generation apparatus described in the following examples generates a magnetic field in a controlled direction in a preset region of a space located adjacent to the magnetic field generation apparatus. The magnetic field generation apparatus may be used in, for example, a wireless energy transmission (WET) field.

For example, to ensure communication and energy transmission between a transmitting end and a receiving end, three reception coils may be wound on a single ferrite core so that they are orthogonal to one another. Each of the three coils may perform communication and energy reception in a different one of three orthogonal axial directions, so the three reception coils may receive energy from a magnetic field having various directions. However, since the three reception coils are three-dimensionally configured, a volume and a weight of a reception end containing the three reception coils may increase. When a permissible size of the reception end is restricted, it may be difficult to implement the coils having the three-dimensional configuration.

As another example, a transmitting end for generating a magnetic field may include a plurality of inductors having axial directions that are orthogonal to one another. In this example, an axis of the magnetic field may be changed by changing an amount of current flowing through each of the inductors and a ratio between the currents flowing through the inductors. Although an axis of a receiving end may change, by changing the axis of the magnetic field at the transmitting end, a communication between the transmitting end and the receiving end may be maintained.

For example, three inductors may be used to generate a magnetic field parallel to each of three axes of a Cartesian coordinate system. Each of the three inductors may wirelessly supply power to a capsule endoscope having an arbitrary orientation in a body. The inductors may have a relatively large volume. For example, two of the inductors may be disposed on opposite sides of the body, and one of the inductors may surround the body. In this example, a system including the inductors for generating the magnetic field parallel to each of the three axes of the Cartesian coordinate system may occupy a relatively large volume, which may make the system inconvenient to use.

As another example, a transmitting end may include a combination of two inductors and a circular plane inductor. The two inductors may be wound around a cross-shaped planar magnetic core. Based on an amount of current flowing through each of the circular plane inductor and the inductors surrounding the cross-shaped planar magnetic core, a magnetic field may be generated in any direction. The aforementioned structure may be a planar geometry. In this case, an issue attributed to the presence of the magnetic core may arise. For example, at a sufficiently high driving frequency, for example, a frequency greater than or equal to 10 megahertz (MHz), an issue related to an absence of an appropriate magnetic material having a sufficiently low loss may arise. Also, the presence of the magnetic material may increase a cost of the wireless power transmission system. Furthermore, by using a ceramic magnetic material for the core to reduce a loss at a high driving frequency, a technical complexity may arise during a production process if the core has large volume.

FIG. 1 illustrates an a configuration of a magnetic field generation apparatus 100.

The magnetic field generation apparatus 100 includes a plurality of coplanar inductors 110 and a current controller 120. For example, the magnetic field generation apparatus 100 may include three coplanar inductors 110 and the current controller 120 to control an amount of current flowing through each inductor. The planar structure may be a structure having a height less than or equal to a predetermined height and having a planar geometry. The planar geometry may be a planar figure including, for example, a structure having the shape of a FIG. 8, a triangle, a quadrangle, a polygon, a circle, or any other geometrical structure. In this example, the planar geometry may also be referred to as a geometry.

The plurality of coplanar inductors 110 may be disposed in the geometry so that vectors of the magnetic field generated by the plurality of coplanar inductors 110 are orthogonal with respect to one another in a preset region and form a three-dimensional basis. A basis is a set of vectors that span a vector space, meaning that any given vector in the vector space may be expressed by a linear combination of the vectors in the set. Each of the vectors in the set is a basis vector.

Each inductor of the magnetic field generation apparatus 100 may have a planar geometry, and the vectors of the magnetic field generated by the inductors may form a full three-dimensional basis. For example, the forming the three-dimensional basis may be formed in a preset region of a space located adjacent to a structure of the planar geometry at a distance less than or equal to a maximum geometrical dimension. The maximum geometrical dimension may be a maximum space and a maximum volume occupied by the magnetic field generation apparatus 100. Also, the preset region may include a specified point at which a magnetic field is generated.

The magnetic field generation apparatus 100 may include three coplanar inductors. The three coplanar inductors may be disposed so that a distance between a plane and each of the three coplanar inductors is less than a maximum geometrical dimension. For example, the three inductors may be disposed to occupy spaces having a size less than a maximum thickness of the magnetic field generation apparatus 100 having a planar structure, and thus the three inductors may form a planar device.

In the preset region of a space on the planar structure of the inductors, vectors of a magnetic field generated by each of the three inductors may form a full basis in a three-dimensional space. For example, three vectors may generate a magnetic field having a predetermined direction and a predetermined magnitude through a linear combination of the three vectors. As an example, a direction of the magnetic field formed through the linear combination of the magnetic fields generated by the plurality of coplanar inductors 110 may be determined based on an amount of current flowing through each inductor.

In this example, the amount of the magnetic field generated by each inductor is proportional to the amount of current flowing through each inductor. For example, by changing the amount of current flowing through each inductor, a magnetic field having a predetermined direction and a predetermined magnitude may be generated in the preset region of the space on the planar structure of the inductors.

The vectors of the three-dimensional basis may be orthogonal with respect to one another. For example, in the preset region in the space of the planar structure of the inductors, vectors of the magnetic fields generated by each inductor may be orthogonal to one another.

Shapes and arrangements of inductors may be determined so that each pairing of the three inductors has a zero mutual inductance. For example, the zero mutual inductance may indicate a state in which a mutual inductance is 0. In this example, an alternating current in each of the three inductors will not induce a voltage in the other two inductors, and thus an amount of current may be independently controlled in each inductor without affecting an amount of current in each of the other inductors.

The alternating current of the inductors may have a phase difference so that the generated magnetic field has a non-linear polarization. For example, the current controller 120 may control a phase difference of an alternating current flowing through each coplanar inductor so that a magnetic field generated by the plurality of coplanar inductors 110 has a non-linear polarization.

The magnetic field generation apparatus 100 may be configured to have a planar geometry. A preset region in a space of a planar structure of inductors may be disposed adjacent to the magnetic field generation apparatus 100 at a distance less than or equal to a maximum geometrical dimension of the magnetic field generation apparatus 100.

By applying a structure corresponding to the planar geometry in lieu of a magnetic material, the magnetic field may be generated in the preset region of the space of the planar structure of inductors without directional restrictions. Through this, a design structure of the magnetic field generation apparatus 100 may be simplified, and costs may also be reduced.

Figure 2:
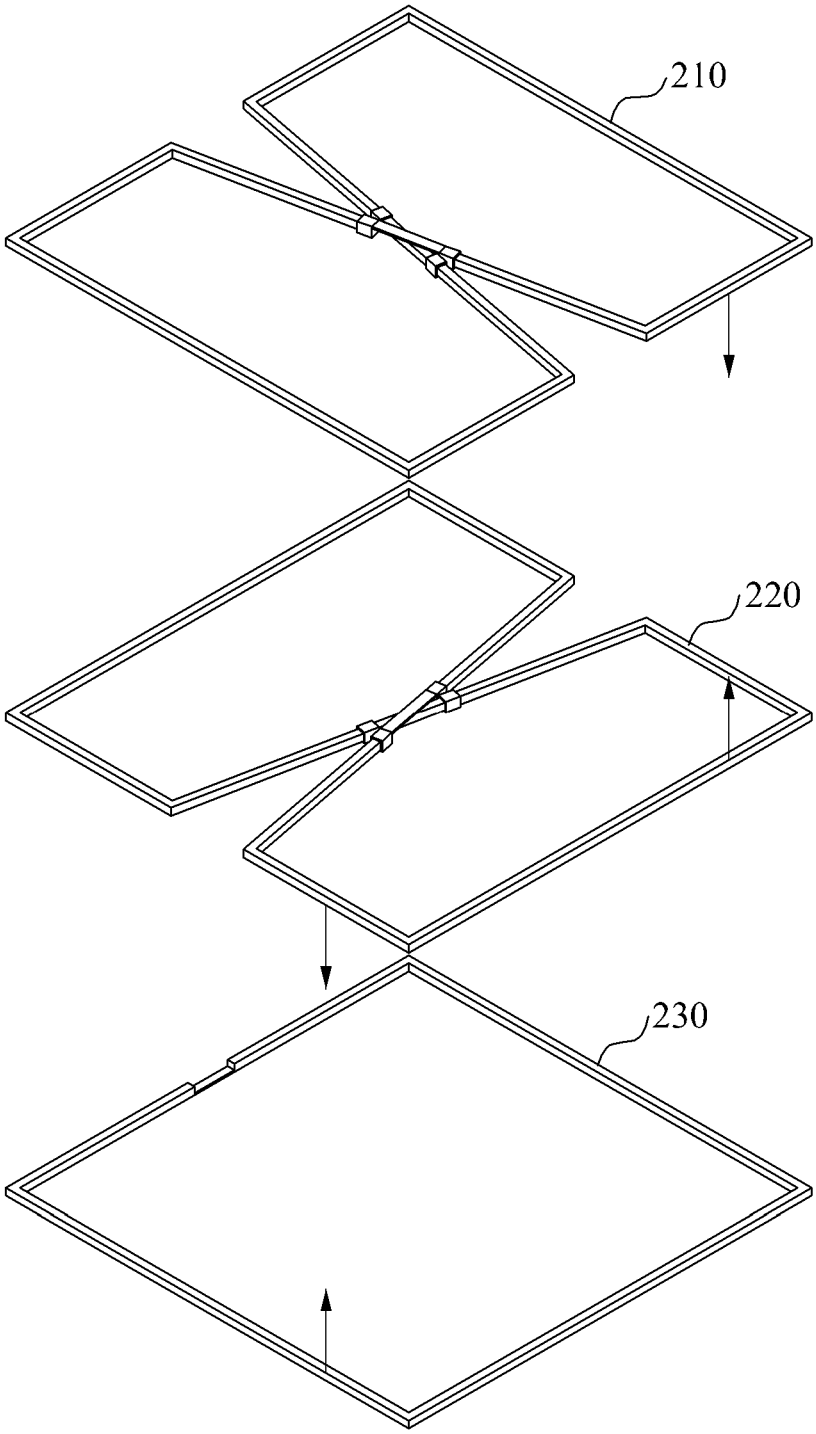
FIG. 2 illustrates an example of three inductors forming a single planar structure in a magnetic field generation apparatus.

FIG. 2 illustrates an example of three inductors forming a single planar structure in a magnetic field generation apparatus.

Referring to FIG. 2, the three inductors include one inductor having the shape of a frame configuring the magnetic field generation apparatus, and two inductors each having the shape of a FIG. 8. The two inductors having the shape of a FIG. 8 are rotated by 90 degrees) (°) with respect to one another. For example, a first inductor 210 having the shape of a FIG. 8 is rotated by 90° relative to a second inductor 220 having the shape of a FIG. 8. A third inductor 230 has the shape of a frame. In this example, the frame may have the shape of an outer frame of the magnetic field generation apparatus.

Figure 3:
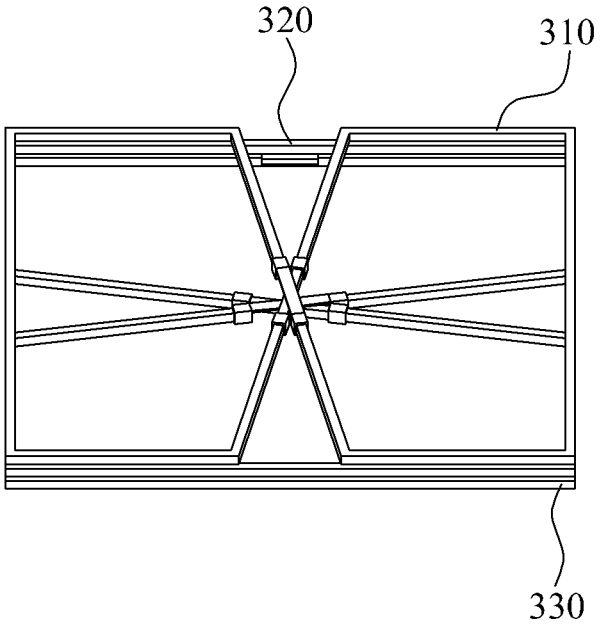
FIG. 3 illustrates an example of a planar structure of three mutually disconnected inductors in a magnetic field generation apparatus.

FIG. 3 illustrates an example of a planar structure of three mutually disconnected inductors in a magnetic field generation apparatus.

Referring to FIG. 3, the three inductors include one inductor having the shape of a frame configuring the magnetic field generation apparatus, and two inductors each having the shape of a FIG. 8. For example, three inductors may be disposed in the magnetic field generation apparatus in a sequence of a first inductor 310 having the shape of a FIG. 8, a second inductor 320 having the shape of a FIG. 8 and rotated by 90° relative to the first inductor 310, and a third inductor 330 having the shape of a frame.

The first inductor 310, the second inductor 320, and the third inductor 330 are combined in a single planar structure as shown in FIG. 3. In FIG. 3, a geometrical center of the planar structure may be a point at which a magnetic field is generated. For example, the third inductor 330 having the shape of the frame configuring the magnetic field generation apparatus generates a magnetic field oriented to be orthogonal to a plane of the third inductor 330 at a specified point. A description of a basis vector of the magnetic field generated by each inductor will be provided with reference to FIG. 4.

Figure 4:
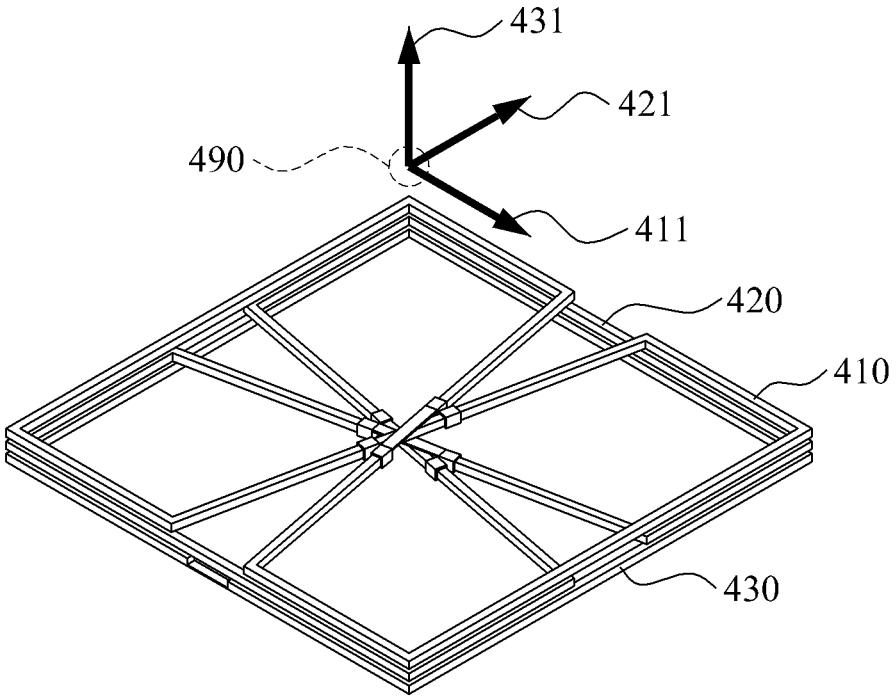
FIG. 4 illustrates an example of basis vectors of a magnetic field generated by a magnetic field generation apparatus.

FIG. 4 illustrates an example of basis vectors of a magnetic field generated by a magnetic field generation apparatus.

Referring to FIG. 4, the basis vectors of the magnetic field are indicated at a point of the planar structure of FIG. 3. The magnetic field is generated by each of three inductors in which the same amount of current flows. For example, a first inductor 410 generates a first basis vector 411, a second inductor 420 generates a second basis vector 421, and a third inductor 430 generates a third basis vector 431. The first basis vector 411 is orthogonal to the second basis vector 421 and the third basis vector 431. The second basis vector 421 is orthogonal to the first basis vector 411 and the third basis vector 431. The third basis vector 431 is orthogonal to the first basis vector 411 and the second basis vector 421.

Inductors having the shape of a FIG. 8 generate a magnetic field parallel to a planar structure at a specified point. Vectors of the magnetic field generated by the inductors at the specified point included in a preset region 490 are orthogonal to one another based on a relative disposition of the inductors having the shape of a FIG. 8. In this example, the vectors of the magnetic field generated by three inductors form a full basis with respect to a three-dimensional space at the specified point.

In the structure of FIG. 4, the inductors are mutually disconnected. For example, through mutual disconnections of the inductors, an alternating current flowing through each of the inductors will not induce voltages in the other two inductors. Since the inductors may operate independently, a process of generating the magnetic field and a current control of the inductors may be simplified.

Figure 5:
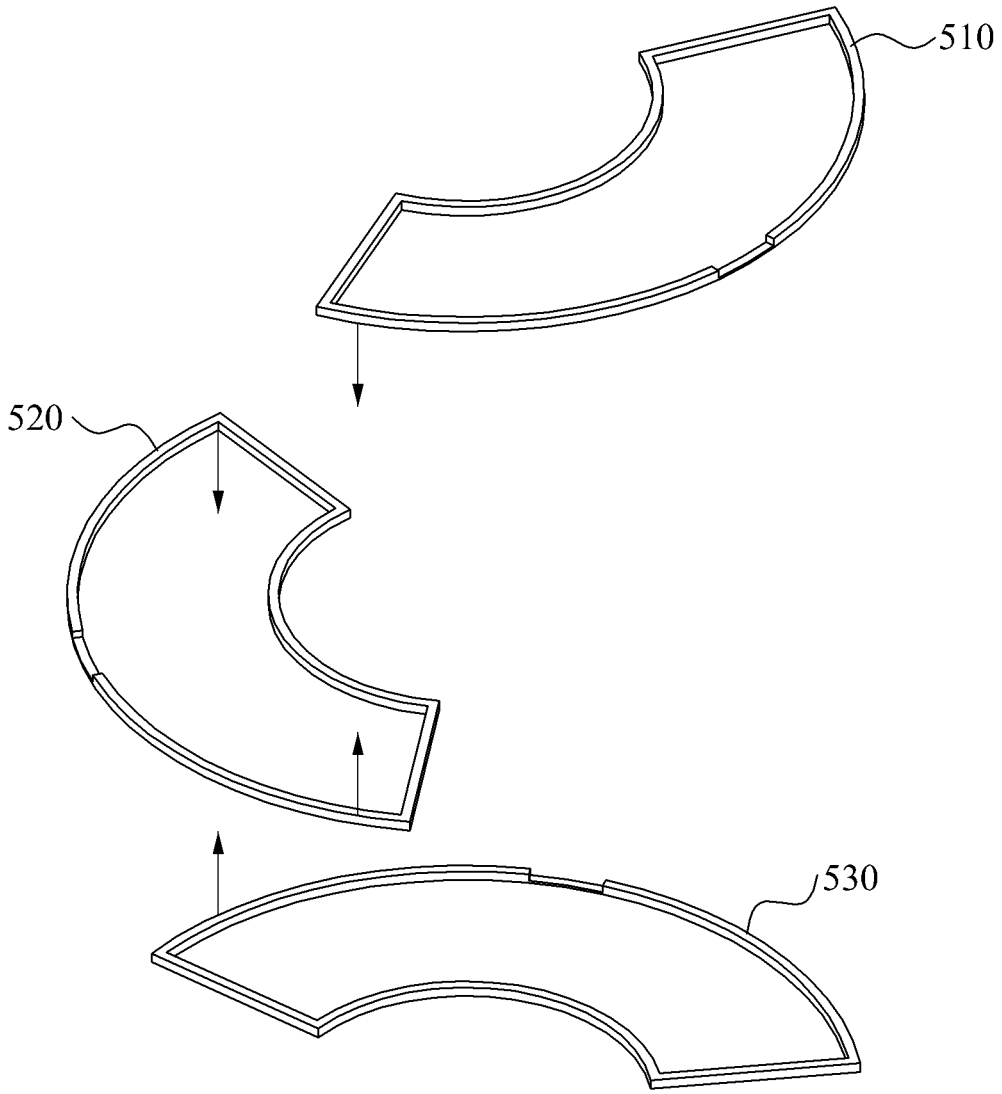
FIG. 5 illustrates an example of three inductors having the shape of a sector of a ring forming a single planar structure of a magnetic field generation apparatus.

FIG. 5 illustrates an example of three inductors having the shape of a sector of a ring forming a single planar structure in a magnetic field generation apparatus.

Referring to FIG. 5, a magnetic field generation apparatus includes a first inductor 510, a second inductor 520, and a third inductor 530 all having a same shape. Each of the first inductor 510, the second inductor 520, and the third inductor 530 has the shape of a sector of a ring.

Figure 6:
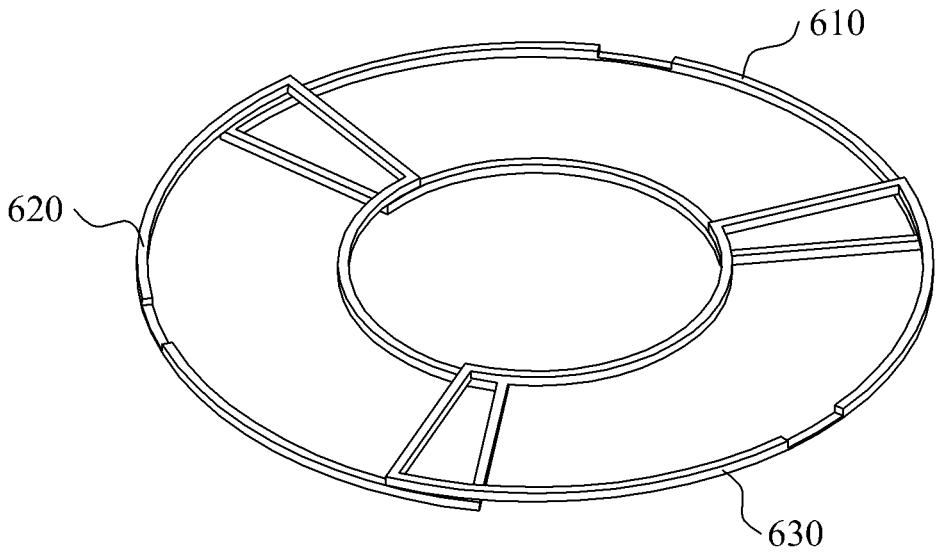
FIG. 6 illustrates an example of a planar structure of three mutually disconnected inductors having the shape of a sector of a ring.

FIG. 6 illustrates an example of a planar structure of three mutually disconnected inductors having the shape of a sector of a ring.

Referring to FIG. 6, three mutually disconnected inductors are combined by being rotated by 120° with respect to one another based on a geometrical center of the planar structure. For example, a first inductor 610 is rotated by 120° relative to a second inductor 620, the second inductor 620 is rotated by 120° relative to a third inductor 630, and the third inductor 630 is rotated by 120° relative to the first inductor 610. By combining the three inductors, a coplanar structure having the shape of a ring is formed. In this example, a specified point at which the magnetic field is generated by the planar structure of FIG. 6 may be located adjacent to the geometrical center of the planar structure.

Figure 7:
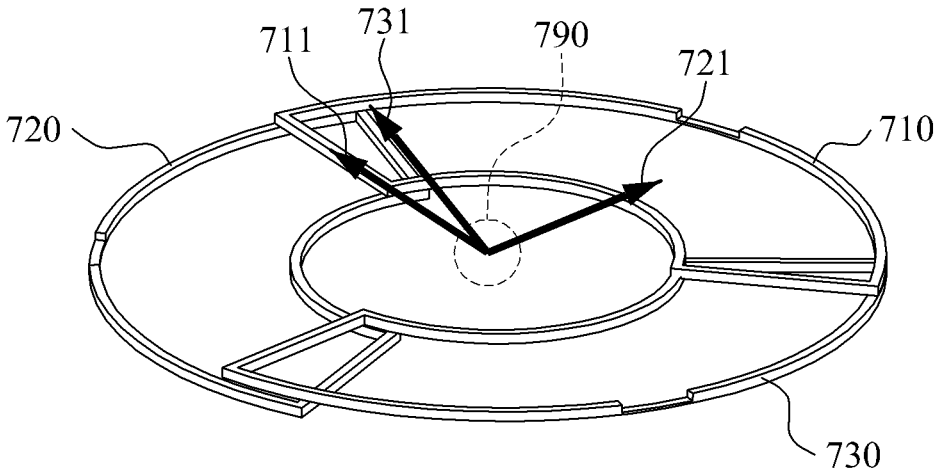
FIG. 7 illustrates another example of basis vectors of a magnetic field generated by a magnetic field generation apparatus.

FIG. 7 illustrates an example of basis vectors of a magnetic field generated by a magnetic field generation apparatus.

Referring to FIG. 7, the basis vectors of the magnetic field are indicated at a specified point in a preset region 790 located in the planar structure of FIG. 6. In the aforementioned planar structure, the basis vectors are basis vectors of a magnetic field generated by each of three inductors in which a same current flows. For example, a first inductor 710 generates a first basis vector 711, a second inductor 720 generates a second basis vector 721, and a third inductor 730 generates a third basis vector 731. The first basis vector 711 is orthogonal to the second basis vector 721 and the third basis vector 731. The second basis vector 721 is orthogonal to the first basis vector 711 and the third basis vector 731. The third basis vector 731 is orthogonal to the first basis vector 711 and the second basis vector 721.

The basis vectors of the magnetic field generated by each of the three inductors at the specified point form a full basis in a three-dimensional space. A distance between the specified point and the planar structure may be determined to enable a specified basis vector to be orthogonal to another basis vector.

In the planar structure of FIGS. 6 and 7, the three inductors partially overlap. An overlapping area of each of the three inductors may be determined to enable each of the three inductors to have a zero mutual inductance with respect to the other two inductors.

A magnetic field generation apparatus may be utilized to generate a magnetic field having a controlled direction in a biomedical science field and a wireless energy transmission system having a receiving end having an arbitrary directional property.

The current controller 120 in FIG. 1 that performs the various operations described with respect to FIGS. 2-7 may be implemented using one or more hardware components, one or more software components, or a combination of one or more hardware components and one or more software components.

A hardware component may be, for example, a physical device that physically performs one or more operations, but is not limited thereto. Examples of hardware components include resistors, capacitors, inductors, power supplies, frequency generators, operational amplifiers, power amplifiers, low-pass filters, high-pass filters, band-pass filters, analog-to-digital converters, digital-to-analog converters, and processing devices.

A software component may be implemented, for example, by a processing device controlled by software or instructions to perform one or more operations, but is not limited thereto. A computer, controller, or other control device may cause the processing device to run the software or execute the instructions. One software component may be implemented by one processing device, or two or more software components may be implemented by one processing device, or one software component may be implemented by two or more processing devices, or two or more software components may be implemented by two or more processing devices.

A processing device may be implemented using one or more general-purpose or special-purpose computers, such as, for example, a processor, a controller and an arithmetic logic unit, a digital signal processor, a microcomputer, a field-programmable array, a programmable logic unit, a microprocessor, or any other device capable of running software or executing instructions. The processing device may run an operating system (OS), and may run one or more software applications that operate under the OS. The processing device may access, store, manipulate, process, and create data when running the software or executing the instructions. For simplicity, the singular term "processing device" may be used in the description, but one of ordinary skill in the art will appreciate that a processing device may include multiple processing elements and multiple types of processing elements. For example, a processing device may include one or more processors, or one or more processors and one or more controllers. In addition, different processing configurations are possible, such as parallel processors or multi-core processors.

A processing device configured to implement a software component to perform an operation A may include a processor programmed to run software or execute instructions to control the processor to perform operation A. In addition, a processing device configured to implement a software component to perform an operation A, an operation B, and an operation C may have various configurations, such as, for example, a processor configured to implement a software component to perform operations A, B, and C; a first processor configured to implement a software component to perform operation A, and a second processor configured to implement a software component to perform operations B and C; a first processor configured to implement a software component to perform operations A and B, and a second processor configured to implement a software component to perform operation C; a first processor configured to implement a software component to perform operation A, a second processor configured to implement a software component to perform operation B, and a third processor configured to implement a software component to perform operation C; a first processor configured to implement a software component to perform operations A, B, and C, and a second processor configured to implement a software component to perform operations A, B, and C, or any other configuration of one or more processors each implementing one or more of operations A, B, and C. Although these examples refer to three operations A, B, C, the number of operations that may implemented is not limited to three, but may be any number of operations required to achieve a desired result or perform a desired task.

Software or instructions for controlling a processing device to implement a software component may include a computer program, a piece of code, an instruction, or some combination thereof, for independently or collectively instructing or configuring the processing device to perform one or more desired operations. The software or instructions may include machine code that may be directly executed by the processing device, such as machine code produced by a compiler, and/or higher-level code that may be executed by the processing device using an interpreter. The software or instructions and any associated data, data files, and data structures may be embodied permanently or temporarily in any type of machine, component, physical or virtual equipment, computer storage medium or device, or a propagated signal wave capable of providing instructions or data to or being interpreted by the processing device. The software or instructions and any associated data, data files, and data structures also may be distributed over network-coupled computer systems so that the software or instructions and any associated data, data files, and data structures are stored and executed in a distributed fashion.

For example, the software or instructions and any associated data, data files, and data structures may be recorded, stored, or fixed in one or more non-transitory computer-readable storage media. A non-transitory computer-readable storage medium may be any data storage device that is capable of storing the software or instructions and any associated data, data files, and data structures so that they can be read by a computer system or processing device. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, or any other non-transitory computer-readable storage medium known to one of ordinary skill in the art.

Functional programs, codes, and code segments for implementing the examples disclosed herein can be easily constructed by a programmer skilled in the art to which the examples pertain based on the drawings and their corresponding descriptions as provided herein.

While this disclosure includes specific examples, it will be apparent to one of ordinary skill in the art that various changes in form and details may be made in these examples without departing from the spirit and scope of the claims and their equivalents. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A magnetic field generation apparatus comprising:

three coplanar inductors disposed to form a planar structure, wherein each of the coplanar inductors is configured to generate a magnetic field having a basis vector that is orthogonal to a basis vector of a magnetic field generated by another one of the coplanar inductors; and a current controller configured to control an amount of current flowing through each of the coplanar inductors to form a magnetic field, in a preset region, having a direction determined by a linear combination of the magnetic fields generated by the coplanar inductors, wherein the coplanar inductors are disposed in a geometry to generate vectors of the magnetic fields by the coplanar inductors being orthogonal with respect to one another in the preset region and to form a three-dimensional basis.

2. The apparatus of claim 1, wherein the current controller is further configured to control a phase difference of the current flowing through each of the coplanar inductors so that the magnetic field formed by the linear combination of the magnetic fields generated by the coplanar inductors has a non-linear polarization.

3. The apparatus of claim 1, wherein the preset region is adjacent to the planar structure at a distance less than or equal to a maximum geometrical dimension of the magnetic field generation apparatus.

4. The apparatus of claim 1, wherein the coplanar inductors are disposed in a geometry so that a mutual inductance of each pair of the coplanar inductors is 0.

5. The apparatus of claim 1, wherein one of the coplanar inductors has a shape of an outer frame of the magnetic field generation apparatus; and two of the coplanar inductors have a shape of a FIG. 8.

6. The apparatus of claim 1, wherein each of the coplanar inductors has a shape of a sector of a ring.

7. A magnetic field generation apparatus comprising:

three coplanar inductors disposed in a planar structure; and a current controller configured to control an amount of current flowing through each of the coplanar inductors;

wherein the coplanar inductors are disposed in a geometry so that vectors of magnetic fields generated by the coplanar inductors form a full three-dimensional basis in a preset region of a space located adjacent to the planar structure at a distance less than or equal to a maximum geometrical dimension of the magnetic field generation apparatus, wherein the current controller is further configured to control the amount of current to form a magnetic field, in the preset region, having a direction determined by a linear combination of the magnetic fields generated by the coplanar inductors.

8. The apparatus of claim 7, wherein the three coplanar inductors are disposed in the geometry so that each pair of the three coplanar inductors has a mutual inductance of 0.

9. The apparatus of claim 7, wherein the vectors of the magnetic fields generated by the three coplanar inductors are orthogonal to one another in the preset region of the space.

10. The apparatus of claim 7, wherein the current controller is further configured to control a phase difference of the current flowing through each of the three coplanar inductors.

11. A magnetic generation apparatus comprising:

three coplanar inductors disposed in a planar structure; and a current controller configured to control an amount of current flowing through each of the coplanar inductors;

wherein each of the coplanar inductors has a shape and an orientation in the planar structure that enables the current controller to control the amount of current flowing through each one of the coplanar inductors without affecting the amount of current flowing through every other one of the coplanar inductors, wherein the current controller is further configured to control the amount of current to form a magnetic field, in the preset region, having a direction determined by a linear combination of the magnetic fields generated by the coplanar inductors.

12. The apparatus of claim 11, wherein the shape and the orientation of each of the coplanar inductors are determined so that each of the coplanar inductors has a mutual impedance of 0 with respect to every other one of the coplanar inductors.

13. The apparatus of claim 11, wherein the coplanar inductors are stacked one on top of another in the planar structure.

14. The apparatus of claim 13, wherein the coplanar inductors comprise:

a first coplanar inductor having a first shape;

a second coplanar inductor having a second shape; and a third coplanar inductor having the second shape and rotated by 90° with respect to the second coplanar inductor.

15. The apparatus of claim 13, wherein the coplanar inductors comprise:

a first coplanar inductor configured to generate a first magnetic field having a first basis vector perpendicular to a plane of the planar structure;

a second coplanar inductor configured to generate a second magnetic field having a second basis vector parallel to the plane of the planar structure; and a third coplanar inductor configured to generate a third magnetic field having a third basis vector parallel to the plane of the planar structure and perpendicular to the second basis vector.

16. The apparatus of claim 11, wherein the coplanar inductors are disposed in a same plane except for an overlapping area of each of the coplanar inductors that overlaps a portion of another one of the coplanar inductors.

17. The apparatus of claim 16, wherein the overlapping area of each of the coplanar inductors is determined so that each of the coplanar inductors has a mutual impedance of 0 with respect to every other one of the coplanar inductors.

18. The apparatus of claim 16, wherein each of the coplanar inductors has a same shape as every other one of the coplanar inductors, and is rotated by a predetermined angle within the planar structure with respect to a geometrical center of the planar structure relative to another one of the coplanar inductors so that each of the coplanar inductors is oriented at a different rotational position within the planar structure relative to every other one of the coplanar inductors.

* * * * *